US005315853A

United States Patent [19]

Scheiterle

[11] Patent Number: 5,315,853

[45] Date of Patent: May 31, 1994

[54] PORTABLE CONSTRUCTION FRAME FORMING APPARATUS

[76] Inventor: Brian L. Scheiterle, 5379 Hammond Rd., Cuba, N.Y. 14727

[21] Appl. No.: 959,656

[22] Filed: Oct. 13, 1992

[51] Int. Cl.[5] ..... B21D 5/08

[52] U.S. Cl. ..... 72/178; 72/226; 242/58.6

[58] Field of Search ..... 72/178, 181-183, 72/226; 242/77, 80, 85, 58.6, 68.3

[56] References Cited

U.S. PATENT DOCUMENTS 865,482 9/1907 Delphey ..... 242/80
909,341 1/1909 Shifley ..... 72/181
3,156,428 11/1964 Dale ..... 242/68.3
3,183,701 5/1965 Cain ..... 72/181
3,886,779 6/1979 McClain ..... 72/181
4,660,399 4/1987 Suter ..... 72/181
4,811,587 3/1989 Knudson ..... 72/181

*Primary Examiner*—Daniel C. Crane
*Attorney, Agent, or Firm*—Leon Gilden

[57] ABSTRACT

An apparatus to construct studding for use in various construction enviroments includes a portable trailer platform having first and second roller housings, wherein each housing includes at least one pair of rollers to effect deformation of metallic sheet material directed from rolls through each respective housing for deformation of various studding components.

1 Claim, 4 Drawing Sheets

PORTABLE CONSTRUCTION FRAME FORMING APPARATUS

BACKGROUND OF THE INVENTION

1. Field of the Invention

The field of invention relates to construction apparatus, and more particularly pertains to a new and improved portable construction frame forming apparatus wherein the same is arranged to the deformation and fabrication of steel stud members for use in a construction environment.

2. Description of the Prior Art

The use of steel studding in the framing and skeleton forming of dwellings and buildings and the like is more typically utilized advantageously to diminish costs and diminish reliance upon wood products for such materials. Steel studs typically have been formed and subsequently transported to a construction site, wherein the instant invention attempts to overcome deficiencies of the prior art by providing for a portably maneuvered platform structure mounting a plurality of elongate housings in adjacency relative to one another to effect the construction and formation of various stud members and in this respect, the present invention substantially fulfills this need.

SUMMARY OF THE INVENTION

In view of the foregoing disadvantages inherent in the known types of construction stud forming apparatus now present in the prior art, the present invention provides a portable construction frame forming apparatus wherein the same is arranged to effect feeding and deformation of metallic frame members. As such, the general purpose of the present invention, which will be described subsequently in greater detail, is to provide a new and improved portable construction frame forming apparatus which has all the advantages of the prior art frame forming apparatus and none of the disadvantages.

To attain this, the present invention provides an apparatus to construct studding for use in various construction environments, including a portable trailer platform having first and second roller housings, wherein each housing includes at least one pair of rollers to effect deformation of metallic sheet material directed from rolls through each respective housing for deformation of various studding components.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable construction frame forming apparatus which has all the advantages of the prior art frame forming apparatus and none of the disadvantages.

It is another object of the present invention to provide a new and improved portable construction frame forming apparatus which may be easily and efficiently manufactured and marketed.

It is a further object of the present invention to provide a new and improved portable construction frame forming apparatus which is of a durable and reliable construction.

An even further object of the present invention is to provide a new and improved portable construction frame forming apparatus which is susceptible of a low cost of manufacture with regard to both materials and labor, and which accordingly is then susceptible of low prices of sale to the consuming public, thereby making such portable construction frame forming apparatus economically available to the buying public.

Still yet another object of the present invention is to provide a new and improved portable construction frame forming apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
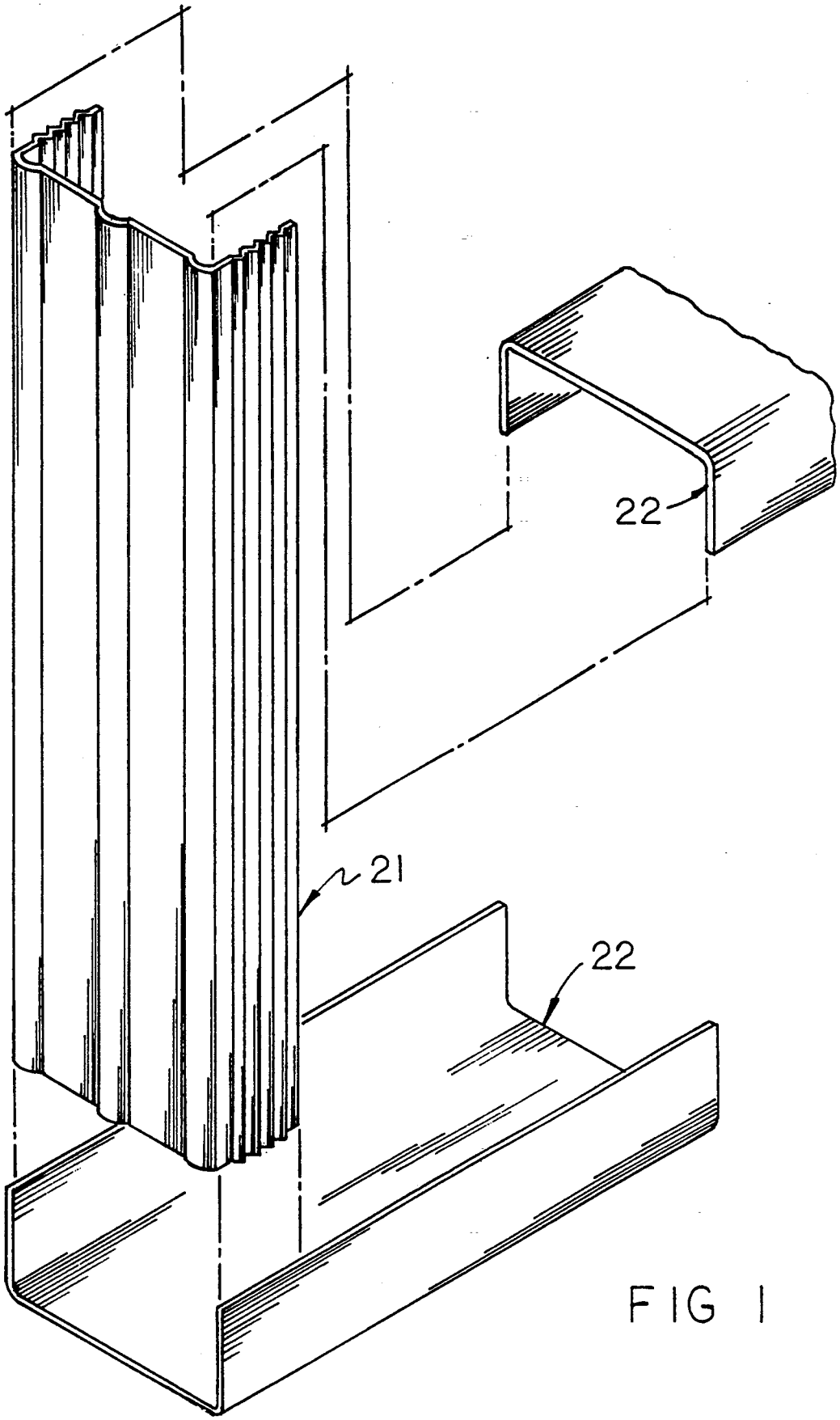
FIG. 1 is an isometric illustration of typical construction components formed by the instant invention.
Figure 2:
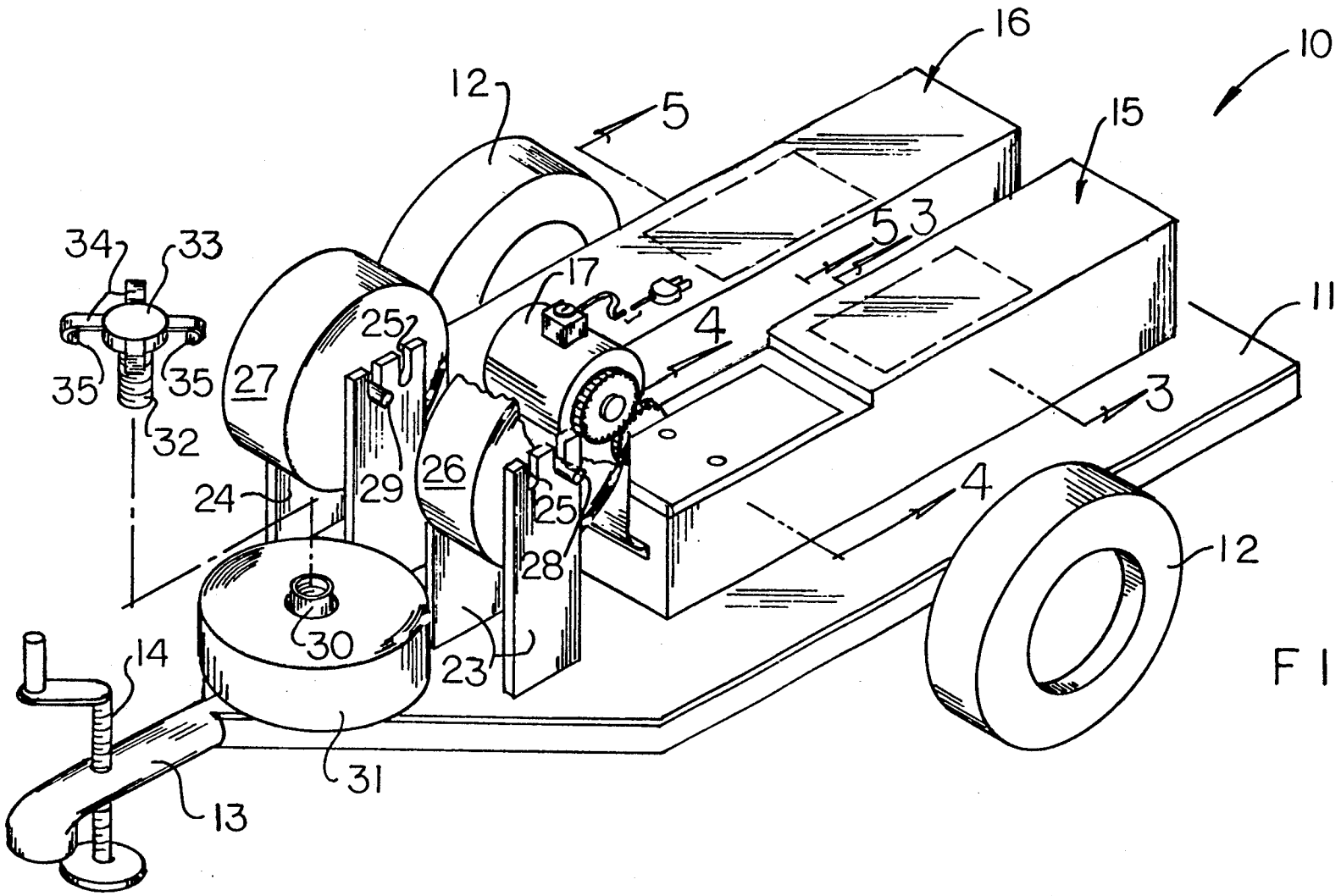
FIG. 2 is an isometric illustration of the invention.
Figure 3:
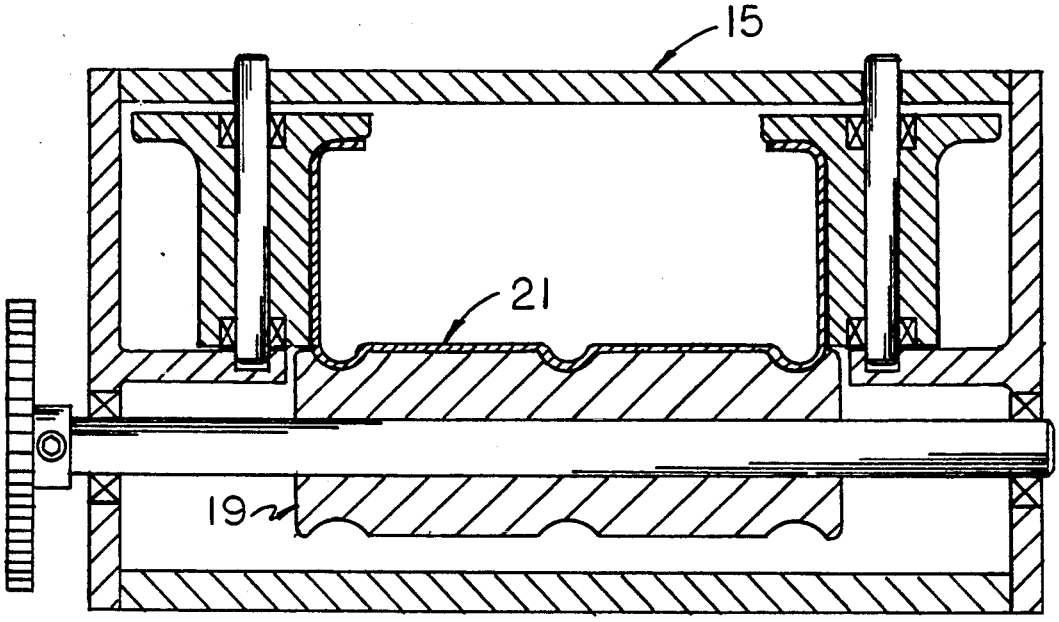
FIG. 3 is an orthographic view, taken along the lines 3—3 of FIG. 2 in the direction indicated by the arrows.

With reference now to the drawings, and in particular to FIGS. 1 to 5 thereof, a new and improved portable construction frame forming apparatus embodying the principles and concepts of the present invention and generally designated by the reference numeral 10 will be described.

More specifically, the portable construction frame forming apparatus 10 of the instant invention essentially comprises a platform 11 having wheels 12 rotatably mounted relative to the platform 12 to permit its portability, with a trailer tongue 13 mounted to a forward distal end of the platform medially of the wheels 12. The trailer tongue 13 includes a positioning jack 14 orthogonally directed through the trailer tongue 13 for providing a three point support of the platform 11 during its use and storage.

Figure 4:
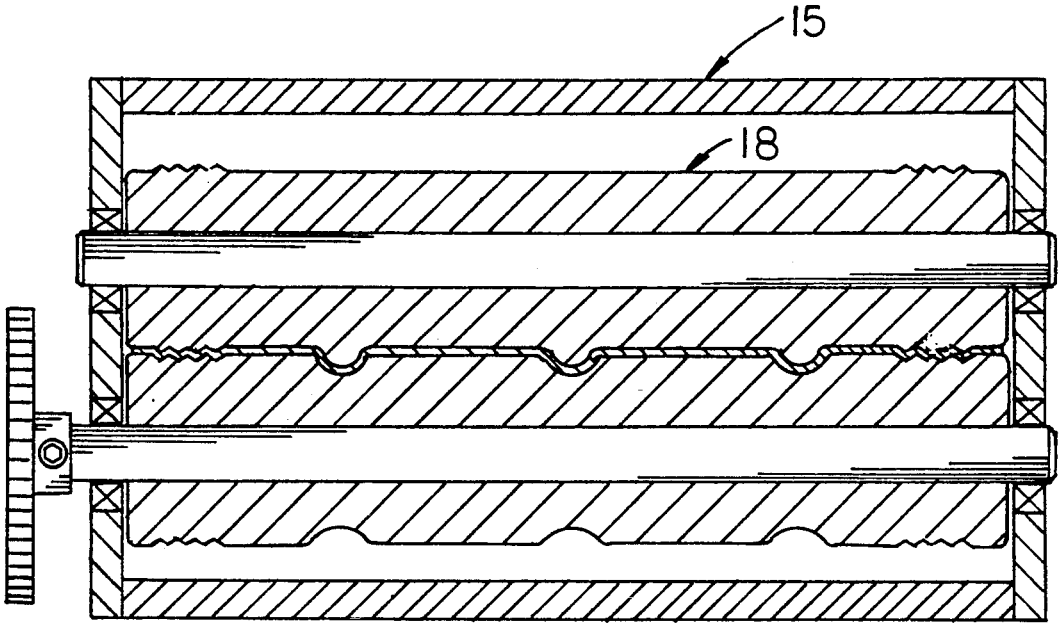
FIG. 4 is an orthographic view, taken along the lines 4—4 of FIG. 2 in the direction indicated by the arrows.
Figure 5:
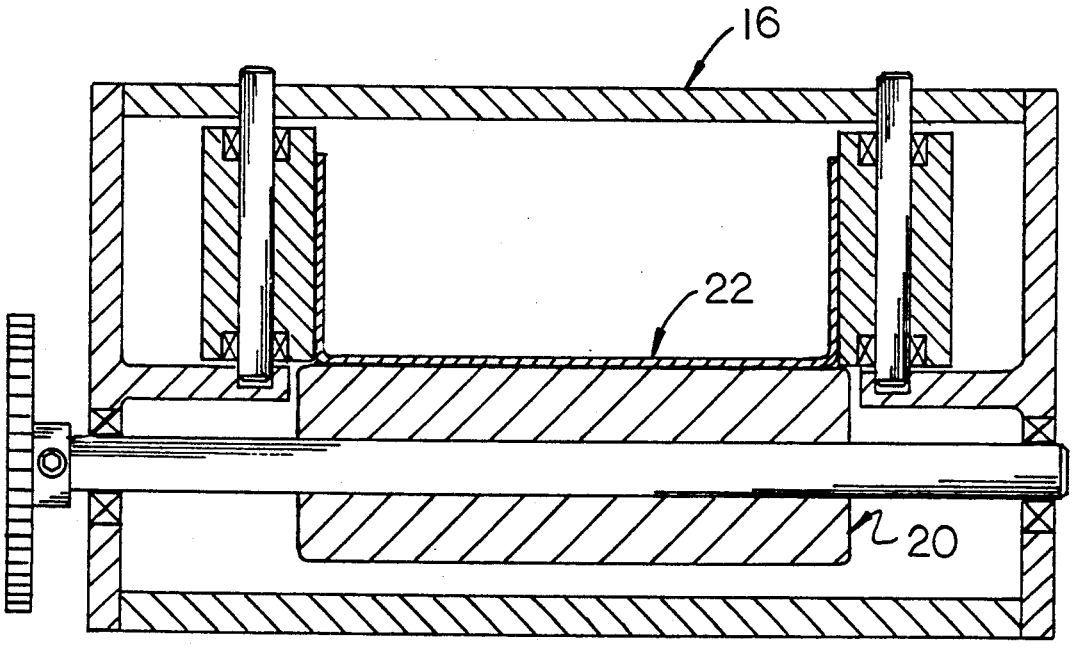
FIG. 5 is an orthographic view, taken along the lines 5—5 of FIG. 2 in the direction indicated by the arrows.

Respective first and second roller housings 15 and 16 are arranged in a parallel coextensive relationship relative to one another, with the first roller housing 15 having first and second roller sets 18 and 19. The first roller set includes a plurality of confronting interdigited roller surfaces, as indicated in FIG. 4, to effect the forming of parallel ribs along the material withdrawn from the first work roll 26, with the second work roll 27 directed through the third roller set 20 to provide for the forming of a generally U-shaped construction member 22 providing for sill and ceiling plates relative to the framing member 21 utilized as a stud member. The driving of the various roller sets is effected through a drive motor 17 having cooperative gearing utilized in any desired conventional relationship to effect simultaneous driving of the first through third roller sets 18 through 20.

The use of first and second support plate pairs 23 and 24 are provided, with the first plate pair 23 having mounting slots 25 to mount the first roll axle 28 of the first work roll 26, with the second support plate pair 24 of a parallel coextensive relationship having mounting slots 25 to mount the second roll axle 29 of the second work roll 27.

A spare work roll 31 of metallic sheet material is mounted through its open central bore or hub upon an internally threaded support tube 30 positioned between the trailer tongue 13 and the first and second support plate pairs 23 and 24 for balancing of the organization to enhance its ease of transport. The internally threaded support tube 30 includes an externally threaded clamp rod 32 threadedly received within the internally threaded support tube 30, with the clamp rod 32 having a clamp rod head 33 at its upper distal end, and the clamp rod head 33 including a plurality of "J" shaped spring plates 34 radially projecting beyond the periphery of the clamp rod head 33, with each of the spring plates 34 including a finger member 35 directed below a respective spring plate along and in a spaced relationship relative to the clamp rod 32 to impinge upon the spare work roll 31 to maintain the spare work roll in position and support such spare work roll free of vibration during transport of the trailer platform in use of the organization when positioned relative to a construction site in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable construction frame forming apparatus, comprising, a platform, the platform having rotatably mounted wheels on opposed sides of the platform, with the platform further including a trailer tongue extending forwardly of the platform medially of the wheels, and the platform further having a first roller housing and a second roller housing fixedly mounted onto the platform between the wheels, and the first roller housing including at least one roller set therewithin, the second roller housing including a further roller set therewithin, and the roller set and the further roller set including drive means to effect simultaneous actuation of the roller set and the further roller set, and first support plate mounted in adjacency to the first roller housing, and second support plates mounted in adjacency to the second roller housing, with the first support plates rotatably mounting a first supply roll, and the second support plates mounting a second supply roll, wherein the first supply roll and the second supply roll are arranged to feed sheet web therefrom into the respective first roller housing and the second roller housing, and the first support plates includes a pair of first plate members, and the second support plates include a pair of second plate members, the first plate members are arranged in a parallel coextensive relationship, and the second plate members are arranged in a parallel coextensive relationship, and the first plate members mount a first roll axle directed through the first supply roll, and the second support plates mount a second roll axle directed through the second supply roll, and further including an internally threaded support tube fixedly mounted to the platform in an orthogonal relationship between the trailer tongue and the first support plates and the second support plates, and the internally threaded support tube arranged for receiving a spare supply roll thereabout, and an externally threaded clamp rod threadedly received within the internally threaded support tube, the clamp rod having a clamp rod head, and the clamp rod head including a plurality of "J" shaped spring plates extending radially and projecting exteriorly of the clamp rod head, where each of the "J" shaped spring plates includes a finger member directed downwardly relative to a respective spring plate along the support tube for impinging upon the spare supply roll to maintain the spare work roll in a fixed and vibrationless relationship relative to the platform.

* * * * *